US006089581A

United States Patent [19]

Partridge

[11] Patent Number: 6,089,581

[45] Date of Patent: Jul. 18, 2000

[54] SNOWBOARD BINDING MOUNTING SYSTEM

[75] Inventor: David McNair Partridge, New Westminster, Canada

[73] Assignee: 4117 Investments Ltd., British Columbia, Canada

[21] Appl. No.: 09/267,907

[22] Filed: Mar. 1, 1999

Related U.S. Application Data

[63] Continuation of application No. 08/555,580, Nov. 8, 1995, abandoned.

[51] Int. Cl.[7] ..... B62B 15/00; A63C 5/00

[52] U.S. Cl. ..... 280/14.2; 280/633; 441/74

[58] Field of Search ..... 280/14.2, 617, 280/618, 620, 633, 634; 441/70, 74, 68

[56] References Cited

U.S. PATENT DOCUMENTS 2,740,972 4/1956 Taylor .
4,604,070 8/1986 McKee et al. .
4,871,337 10/1989 Harris .
4,969,655 11/1990 Katz .
5,035,443 7/1991 Kincheloe .
5,141,243 8/1992 Meatto .
5,344,179 9/1994 Fritschi et al. .
5,433,636 7/1995 Gillis .
5,474,322 12/1995 Perkins et al. .
5,609,351 3/1997 Vermillion .

*Primary Examiner*—Brian L. Johnson
*Assistant Examiner*—Bridget Avery
*Attorney, Agent, or Firm*—Hall, Priddy, Myers & Vande Sande

[57] ABSTRACT

A system is provided for mounting bindings to a snowboard. The system allows relative distance between the mounted bindings to be much more accurately adjusted by the user, making snowboarding mare enjoyable and safer. The system involves a front and a rear set of parallel cavities formed on the top surface of a snowboard which accept nuts which slide in each cavity. Each nut receives a corresponding bolt from the binding to be mounted. The nuts can be easily replaced if stripped, obviating the need for frequent expensive repairs to fix stripped nuts, as is common with typical snowboards.

3 Claims, 5 Drawing Sheets

SNOWBOARD BINDING MOUNTING SYSTEM

This application is a continuation of U.S. patent application Ser. No. 08/555,580 filed Nov. 8, 1995.

FIELD OF THE INVENTION

This invention relates to snowboards and more particularly to a system for mounting bindings onto snowboards.

BACKGROUND OF THE INVENTION

The sport of snowboarding has become a very popular winter recreational activity. With mainstream acceptance of the sport, the technological sophistication of snowboards has increased at a rapid rate as has the concomitant cost of snowboards and snowboard accessories.

Although many advances have been made in snowboard technology, snowboard bindings and systems for mounting these bindings on a snowboard have changed little. The two types of bindings typically used today on snowboards are the "base" bindings which have a bottom plate which rests against the upper surface of the snowboard when mounted on the snowboard, and the "baseless" bindings which do not have such a plate, allowing the skier's boot to contact the snowboard directly. Both types of bindings are typically mounted on a snowboard by means of four bolts or screws. These bolts typically engage four "T" nuts embedded partially within the snowboard's core.

Typically, a quality snowboard will have five or six pairs of bolt-engaging "T" nuts, positioned towards each of the front and rear ends of the snowboard, although many snowboards have fewer. Two of these pairs of "T" nuts, four "T" nuts in total, are used to mount one binding. The appropriate set of "T" nuts to be used depends upon the type of binding mounted. A "base" binding utilizes two adjacent pairs of "T" nuts, while a "baseless" binding utilizes two pairs of "T" nuts which are separated from each other by one or more unused pairs of "T" nuts.

The availability of five or six pairs of "T" nuts allows a snowboarder to mount the bindings at a selected location on the snowboard. Both the front and rear bindings may be selectively mounted in this fashion, allowing the snowboarder to adjust the relative distance between the front and rear bindings according to his or her own comfort. For example, a very tall snowboarder, preferring a wide stance, will likely mount bindings using the appropriate set of "T" nuts located farthest from the centre of the snowboard, thus maximising relative distance between the bindings. On the other hand, a shorter snowboarder may prefer a narrower stance.

This method of mounting bindings has a number of major disadvantages. Firstly, because each binding can be mounted only in discrete positions along a portion of the snowboard, there are a limited number of mounting combinations which give the snowboarder only a restricted range of choices for width of snowboarding stance. A snowboarder may find that one combination of mounting positions gives too narrow a stance and that the next-widest stance provided by a different combination of mounting positions is too wide. This problem reduces enjoyment of the sport and can lead to injury of the snowboarder.

Secondly, a limited number of mounting combinations gives the snowboarder a restricted range of choices for relative position of stance along the snowboard. Some snowboarders prefer to stand near the front end of the snowboard, while others prefer to stand near the rear end of the snowboard. One combination of mounting positions may prove to be too near one end of the board, while the nest nearest combination of mounting positions may prove to be too far from that end of the board.

A third problem with the typical mounting system is that the "T" nuts may be "stripped" if an excessive amount of torque is applied in screwing the bindings onto the snowboard or if the bindings are incorrectly screwed onto the snowboard by forcing the mounting screws into the "T" nuts at an angle such that the "T" nuts become cross-threaded. Also, a snowboarder may apply so much torque to the snowboard in use that the bindings may actually be "ripped out" of the snowboard. This unfortunately is a common occurrence which results in the loss of at least one mounting position to the snowboarder and again limits the number of stances available to the snowboarder. If enough "T" nuts are stripped, the snowboard becomes essentially useless unless costly repairs involving replacement of the stripped "T" nuts can be made to the snowboard.

The binding mounting system of the present invention ameliorates these problems.

SUMMARY OF THE INVENTION

The present invention provides a system for mounting bindings onto a snowboard. The invention comprises: (a) a snowboard having a top surface and a bottom surface; (b) first and second longitudinally extending cavities within the snowboard, between the top and bottom surfaces, each of the cavities having: (i) a coextensive, narrow, slotted opening communicating through the top surface; and (ii) an enlarged opening communicating through the top surface along a short portion of the slotted opening; and (c) at least one nut slidably engaged within each of the cavities to align the nut for fastening engagement with a bolt passed through the slotted opening, the nut having a laterally extending portion wider than the slotted opening and narrower than the enlarged opening.

In a preferred embodiment of the invention, each of the nuts has a flanged head narrower than the enlarged opening and wider than the slotted opening and a threaded barrel portion fixed to the head portion. The barrel portion of the nut protrudes upwardly through the slotted opening and may extend vertically above the snowboard top surface or may remain flush with the top surface of the snowboard. It is also preferred that the first and second cavities be substantially parallel, in substantially parallel relation to the longitudinal axis of the snowboard, in a predetermined spaced relation to one another, and substantially equidistant from the longitudinal axis of the snowboard.

Preferably, the first and second cavities are each defined by a channelled member bonded into the core of the snowboard. The channelled member comprises a bottom portion, two wall portions and a top portion formed either by flange members extending longitudinally along the top of the wall portions, or by the laminates used in construction of the top surface of the snowboard overhanging the wall portions of the channelled member. The channelled member may have lower outwardly extending flanges.

In a first embodiment of the invention, the enlarged opening is intermediate the longitudinal ends of the cavities. In a second embodiment, the enlarged opening is located at one longitudinal end of the cavities.

The invention also provides a method of mounting a boot binding on a snowboard, the method comprising the steps of: (a) providing first and second longitudinally extending cavities within the snowboard, each of the cavities having: (i) a coextensive, narrow, slotted opening communicating through a top surface of the snowboard; and (ii) an enlarged opening communicating through a top surface of the snowboard along a short portion of the slotted opening; (b) for each of the cavities, inserting a flanged head of at least one nut through the enlarged opening into the cavity and slidably advancing the nut along the cavity to a selected location away from the enlarged opening, with a threaded barrel portion of the nut protruding upwardly through the slotted opening; and, (c) threadably fastening mating bolt portions of the boot binding to the nuts.

BRIEF DESCRIPTION OF THE DRAWINGS

In drawings which illustrate embodiments of the invention.

DETAILED DESCRIPTION OF THE PREFERRED EMBODIMENT

Figure 1:
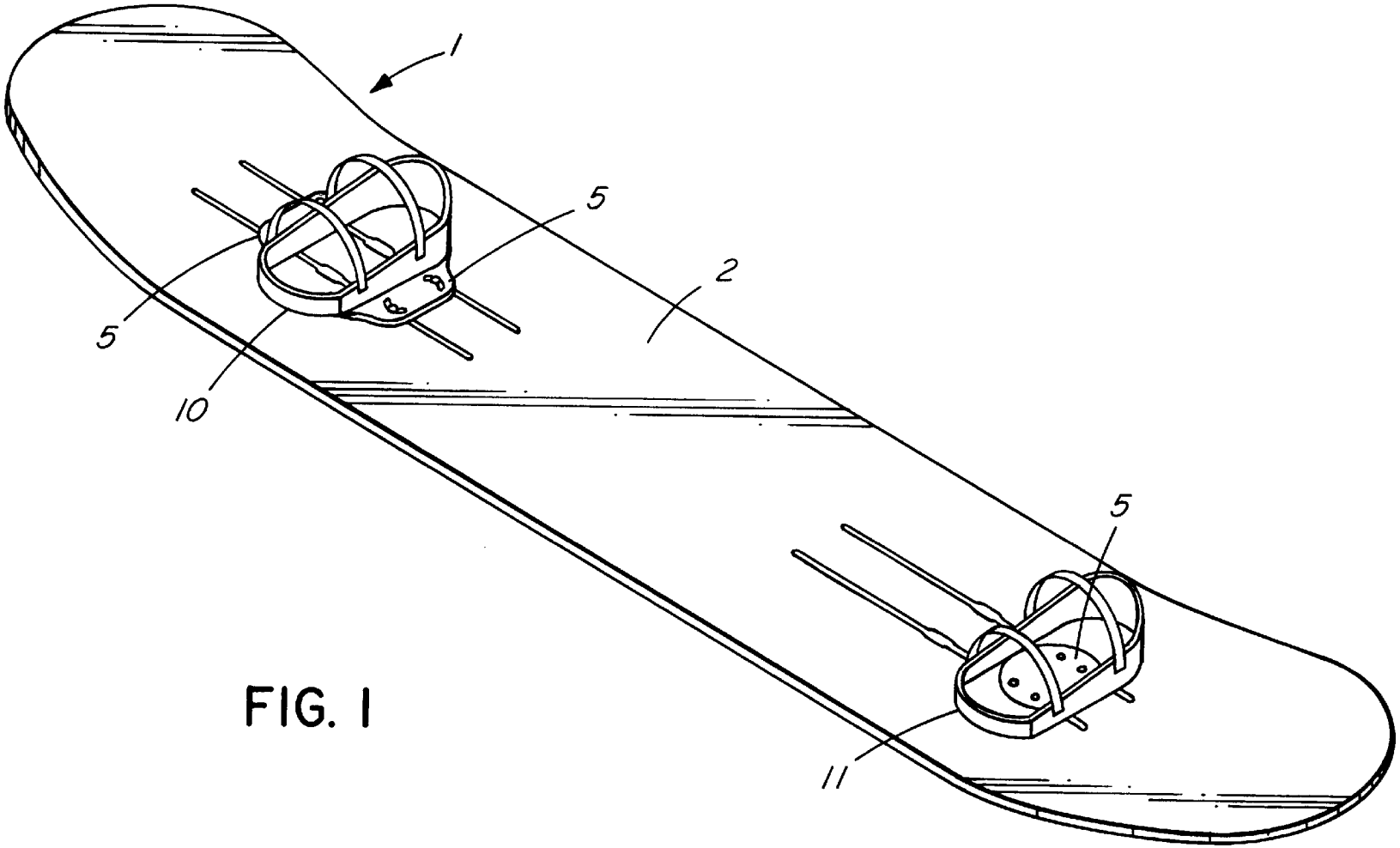
FIG. 1 is a perspective view of a snowboard, showing both a "base" binding and a "baseless" binding mounted thereon in accordance with a first embodiment of the binding mounting system of the present invention.
Figure 3:
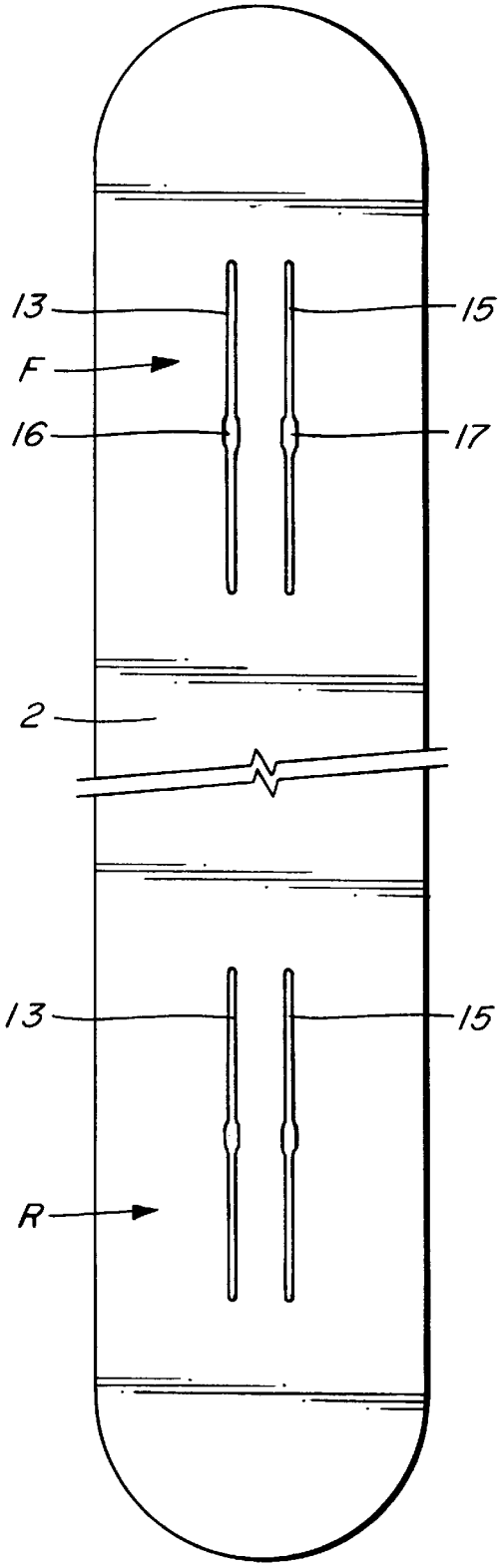
FIG. 3 is a top plan view of a snowboard having a binding mounting system in accordance with the first embodiment of the present invention.
Figure 4:
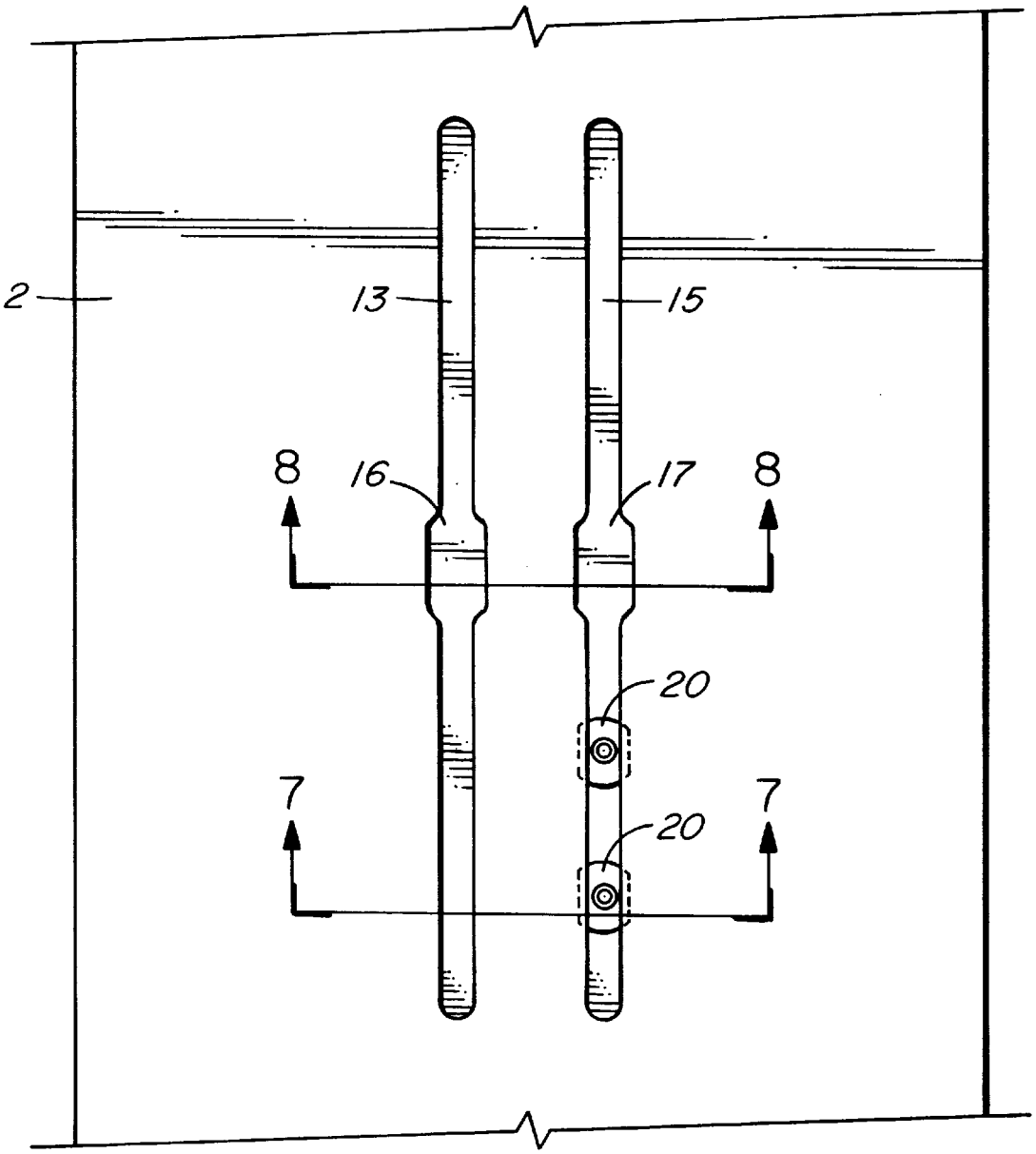
FIG. 4 is an enlarged fragmentary view of the upper surface of a snowboard having a binding mounting system according to the first embodiment of the present invention.

With reference to FIGS. 1, 3 and 4 of the accompanying drawings, the present invention comprises a system for mounting either a baseless binding 10 or a base binding 11 onto a snowboard 1. Bindings 10, 11 may have various binding mounting members, indicated generally by reference numeral 5.

First and second cavities 12, 14 (shown in FIGS. 7 and 8) extend longitudinally along snowboard 1. Slotted openings 13, 15 somewhat narrower than the cavities themselves are provided in the top surface of snowboard 1, along the entire length of each cavity. Cavities 12, 14 may extend longitudinally along substantially the entire length of snowboard 1, but it is normally preferred to provide front and rear pairs of cavities as indicated in FIG. 3 by the reference letters "F" and "R". The front ("F") pair of cavities 12, 14 is located near the front end of snowboard 1 for mounting a front binding as hereinafter described; and the rear ("R") pair of cavities 12, 14 is located near the rear end of snowboard 1 for mounting a rear binding. Preferably, cavities 12, 14 are each at least 11 inches in length.

Figure 9:
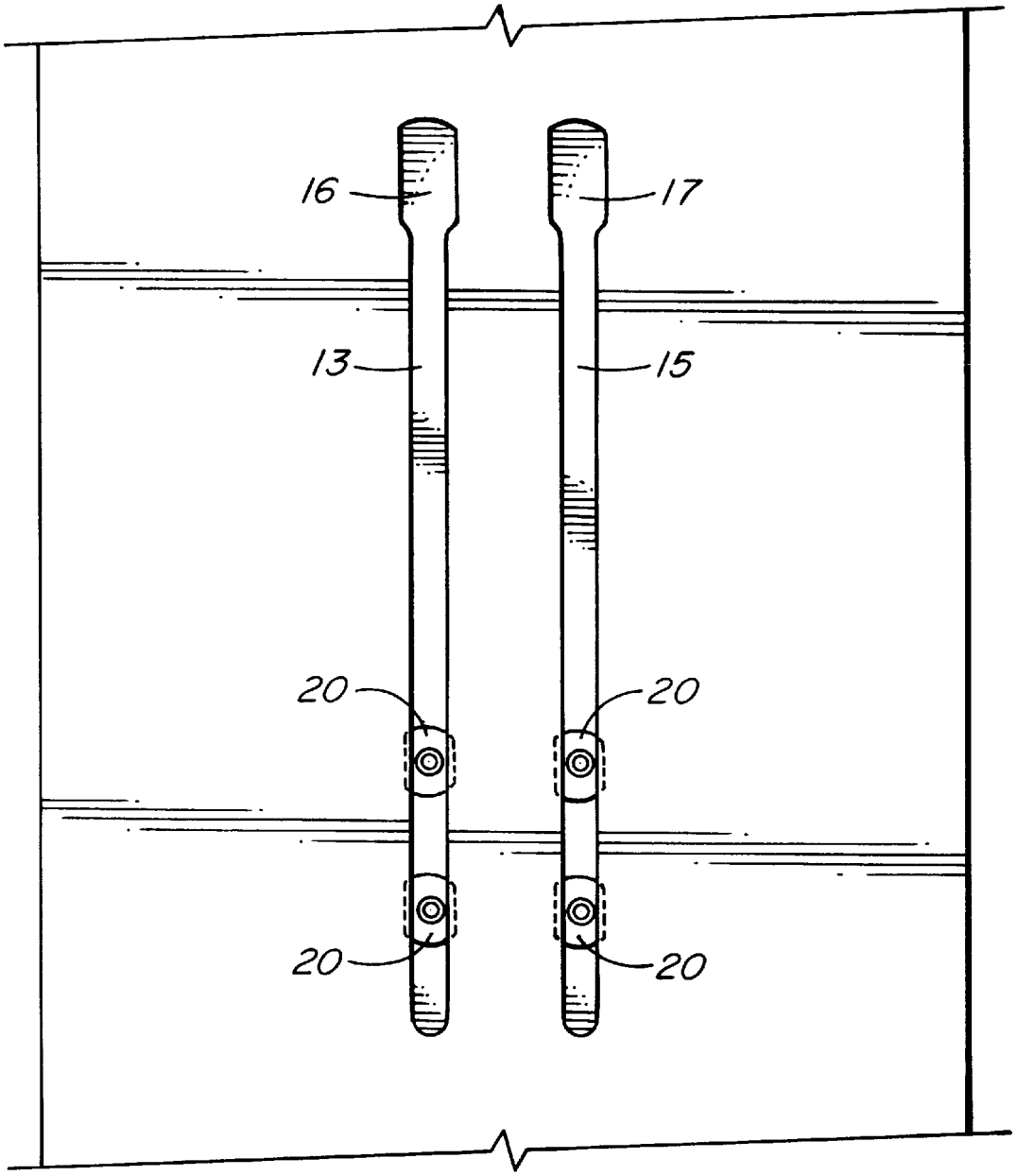
FIG. 9 is an enlarged, fragmentary view of the upper surface of a snowboard having a binding mounting system according to a second embodiment of the invention.

As best shown in FIG. 4, enlarged portions 16 and 17 are provided in each of the slotted openings 13, 15 atop the respective cavities. Enlarged portions 16, 17 may be intermediate the ends of cavities 12, 14, or may be formed at either end of cavities 12, 14 as shown in FIG. 9. Benefits of both arrangements are discussed below.

Figure 2:
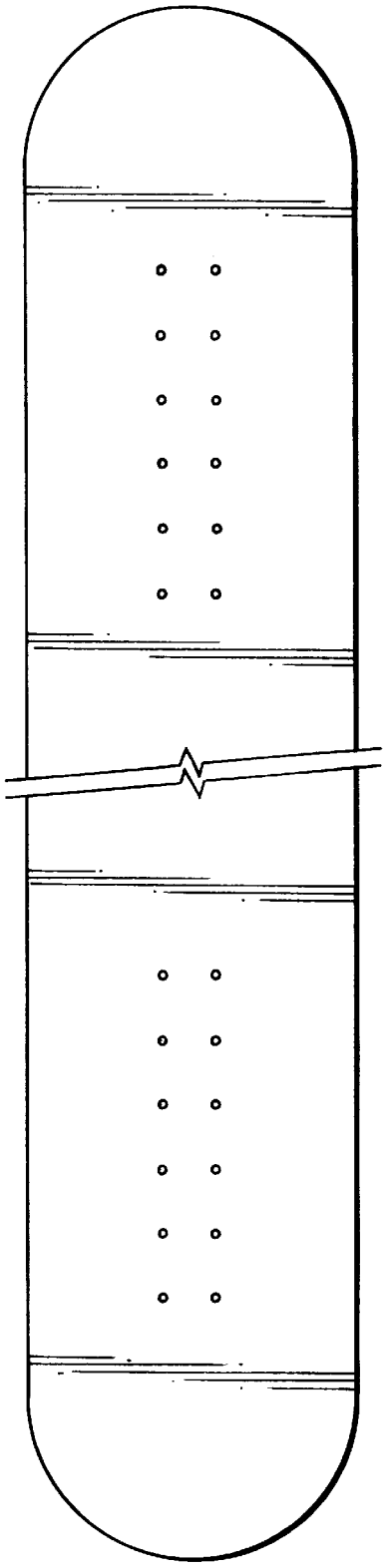
FIG. 2 PRIOR ART
FIG. 2 is a top plan view of a typical prior art snowboard showing mounting holes for mounting bindings.
Figure 5:
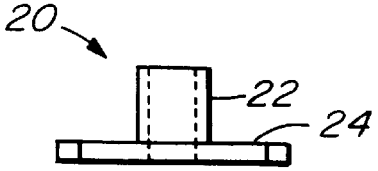
FIG. 5 is a side elevational view of a "T" nut for use with snowboard binding mounting systems constructed in accordance with the invention.
Figure 6:
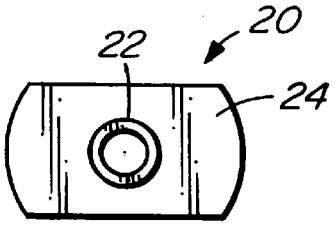
FIG. 6 is a top plan view of the "T" nut of FIG. 5.

Enlarged portions 16, 17 are made wide enough to allow the head of a threaded nut to pass into or out of cavities 12, 14. Preferably, the threaded nut used is a "T" nut 20 (FIGS. 5 and 6), although other nuts, such as flat hexagonal nuts, may be used. "T" nut 20 is of the type which is fixedly embedded within typical prior art snowboards, illustrated in FIG. 2. "T" nut 20 has an internally threaded cylindrical portion 22 adapted to receive a bolt (not shown) provided on the binding members 5 of the bindings to be mounted on snowboard 1, and a flange portion 24.

Figure 7:
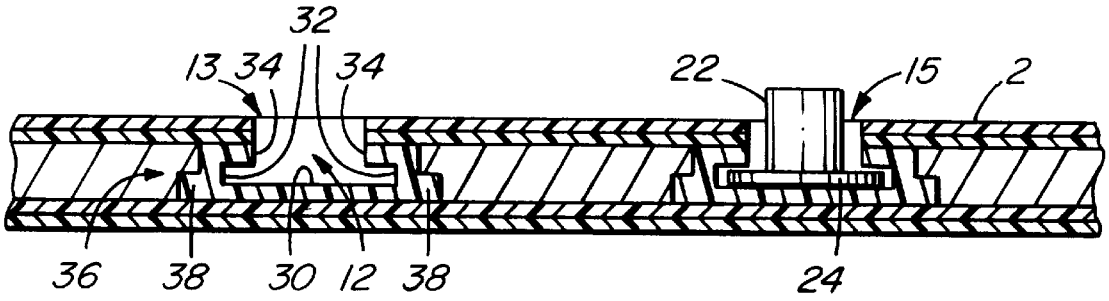
FIG. 7 is a cross sectional illustration taken with respect to line 7—7 of FIG. 4.
Figure 8:
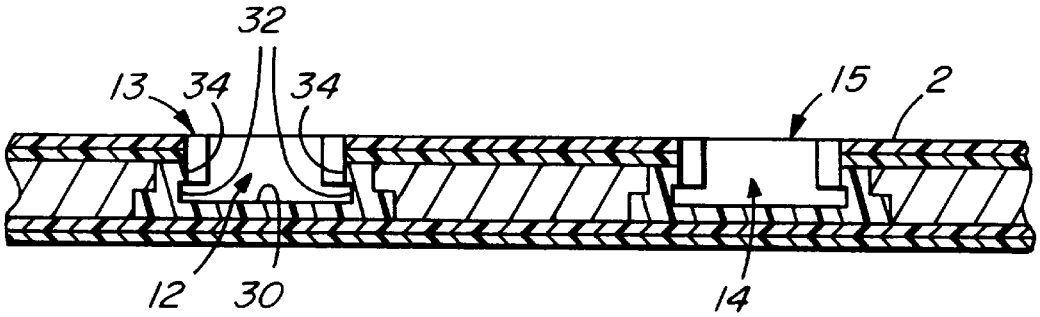
FIG. 8 is a cross sectional illustration taken with respect to line 8—8 of FIG. 4.

As shown in FIGS. 7 and 8, cavities 12, 14 are defined by a bottom portion 30, two wall portions 32 and top portions 34. In the preferred embodiment, bottom portion 30 and wall portions 32 may be defined by a prefabricated channelled member 36 bonded into the core of snowboard 1 during the snowboard manufacturing process. Channelled member 36 may be of any suitable construction and material but is preferably of a rigid plastic capable of use in cold temperatures. Channelled member 36 may have lower outwardly extending flanges 38 to strengthen attachment of member 36 within the core of snowboard 1.

Top portions 34 may be longitudinally extending flanges formed along the top of wall portions 32 of channelled member 36, or may be formed by the top layers of the laminates used in construction of top surface 2 of snowboard 1. In either case, the gap left between the opposed inwardly extending edges of top portions 34 defines the width of the slotted openings 13, 15 which extend through the snowboard's top surface 2 above the respective cavities 12, 14. Enlarged portions 16, 17 of cavities 12, 14 are formed by enlarging the aforesaid gap over a short distance in each of openings 13, 15.

"T" nuts 20 are passed downwardly through the gap between opposed top portions 34 at each of enlarged portions 16, 17. The "T" nuts can then be slidably advanced along the respective cavities, away from the insertion point defined by enlarged portions 16, 17. The reduced width of slotted openings 13, 15 away from the enlarged insertion points traps each "T" nut's flange 24 firmly within the respective cavities.

Figure 7A:
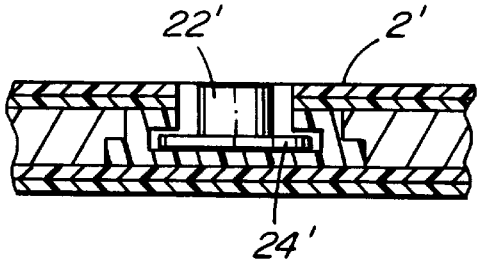
FIG. 7A is a partial cross-sectional view illustrating a flush mounted nut embodiment of this invention.

The top of cylindrical portions 22 of "T" nuts 20, when accommodated in cavities 12, 14, may be flush with the top surface 2 of snowboard 1 (as shown in FIG. 7A, wherein like parts are numbered similarly but with an apostrophe). However, the top of cylindrical portions 22 preferably extend through top portions 34 of cavities 12, 14, and further extends above the top surface 2 of snowboard 1. The advantage provided by this arrangement is that "T" nut 20 has a larger bolt-engaging threaded area than does a flat hexagonal nut, thereby providing increased strength of attachment to a snowboard binding. Furthermore, "T" nut 20 is more easily manipulable if it extends above top surface 2 of snowboard 1 than is a flat hexagonal nut which must be manipulated with some object capable of projecting into cavities 12, 14. Good manipulability is important where such a nut may be required to be replaced while one is snowboarding. If a "T" nut is stripped and a binding is "ripped out" while on the ski hill, a snowboarder can replace the stripped "T" nut and continue snowboarding.

In operation, a plurality of "T" nuts 20 are placed into cavities 12, 14 through the insertion points defined by enlarged portions 16, 17, and slid longitudinally away from the insertion points so that the flange portions 24 of "T" nuts 20 are substantially engaged by the bottom portion 30, wall portions 32 and top portions 34 defining cavities 12, 14. The flange portions 24 of the "T" nuts 20 are preferably loosely engaged by cavity 12, 14 to allow easy longitudinal sliding of "T" nuts 20 along cavities 12, 14 by hand.

Typically, two "T" nuts 20 are slid into each cavity 12, 14 through enlarged portions 16, 17. A total of four "T" nuts are then available to accept four bolts (not shown) to secure mounting members 5 of a single binding to the top surface 2 of the snowboard 1. A stripped or otherwise useless "T" nut 20 may be replaced in cavities 12, 14 by sliding that "T" nut to enlarged portions 16, 17, removing it, and placing a new "T" nut into cavities 12, 14 through enlarged portions 16, 17.

Enlarged portions 16, 17 may be located at an end portion of cavities 12, 14, or at some intermediate portion. An advantage of locating enlarged portions 16, 17 at an intermediate portion of cavities 12, 14 is that a selected "T" nut contained in cavities 12, 14 may be removed or replaced without removing the other "T" nut(s) from the cavity. Secondly, when using "base" bindings, the binding will, unless positioned at either extreme end of cavities 12, 14, cover enlarged portions 16, 17, which some may believe to be unsightly.

As will be apparent to those skilled in the art in the light of the foregoing disclosure, many alterations and modifications are possible in the practice of this invention without departing from the spirit or scope thereof. For example, although "T" nuts 20 are preferred, they may be replaced by flat hexagonal nuts or other equivalent fasteners capable of securely engaging a mating fastening element provided on a snowboard binding. Accordingly, the scope of the invention is to be construed in accordance with the substance defined by the following claims.

What is claimed is:

1. A snowboard having a binding mounting system therein, the combination comprising:

a) a snowboard having a top surface, a bottom surface, side surfaces and a core occupying the volume bounded by said surfaces;

b) first and second longitudinally extending, substantially parallel cavities within said core, c) each said cavity including a longitudinally extending channelled member bondably attached to said core, said channelled member comprising a bottom portion, a pair of spaced opposing outer wall portions, a pair of opposing inwardly projecting top portions projecting a finite distance one toward the other thereby to define a slotted longitudinally extending opening therebetween of lesser width than the spaced distance between said opposing sidewalls, said portions cooperating to define a nut cavity therebetween;

d) said channelled member further comprising a pair of flanges projecting outwardly from each of said outer wall portions and extending into said core a sufficient distance to strengthen the attachment of said channelled member within said core;

e) said slotted opening including an enlarged portion of sufficient size to allow a nut to be inserted therethrough; and f) said nut slidably retained in said nut cavity of each of said channelled members; said nut including a flanged head and a barrel upwardly extending from said flanged head and provided with a threaded portion for receiving a binding retaining bolt therein, said flanged head comprising a laterally extending portion wider than said width of said slotted opening and narrower than said width of said enlarged portion.

2. A snowboard binding mounting system as defined in claim 1, the top of said barrel portion of said nut protrudes upwardly through said slotted opening being flush with said snowboard top surface.

3. A snowboard binding mounting system as defined in claim 1, said barrel portion protrudes upwardly through said slotted opening and extends vertically above said snowboard top surface.

* * * * *